United States Patent [19]

McCleary et al.

[11] 4,335,525

[45] Jun. 22, 1982

[54] BALLOON DRYER

[75] Inventors: David R. McCleary, Orangeville; Djuro Slivar, Brampton, both of Canada

[73] Assignee: Superior Rubber Industries Ltd., Orangeville, Canada

[21] Appl. No.: 247,910

[22] Filed: Mar. 26, 1981

Related U.S. Application Data

[63] Continuation-in-part of Ser. No. 177,569, Aug. 13, 1980, abandoned.

[51] Int. Cl.[3] ..... F26B 15/22

[52] U.S. Cl. ..... 34/4; 34/39; 34/105; 34/203; 34/236; 118/642; 198/626

[58] Field of Search ..... 34/4, 39, 203, 236, 34/105; 118/642, 643; 198/626

[56] References Cited

U.S. PATENT DOCUMENTS 4,193,204 3/1980 Nerod ..... 34/4

4,236,482 12/1980 Gingerich et al. ..... 118/642

*Primary Examiner*—Larry I. Schwartz

[57] ABSTRACT

A balloon dryer comprises facing inner and outer belts which hold the neck of the balloon closed between them. The inner belt is driven, while the outer belt is an idler being driven by the inner belt, in a preferred embodiment of the invention.

41 Claims, 7 Drawing Figures

BALLOON DRYER

Figure 1:
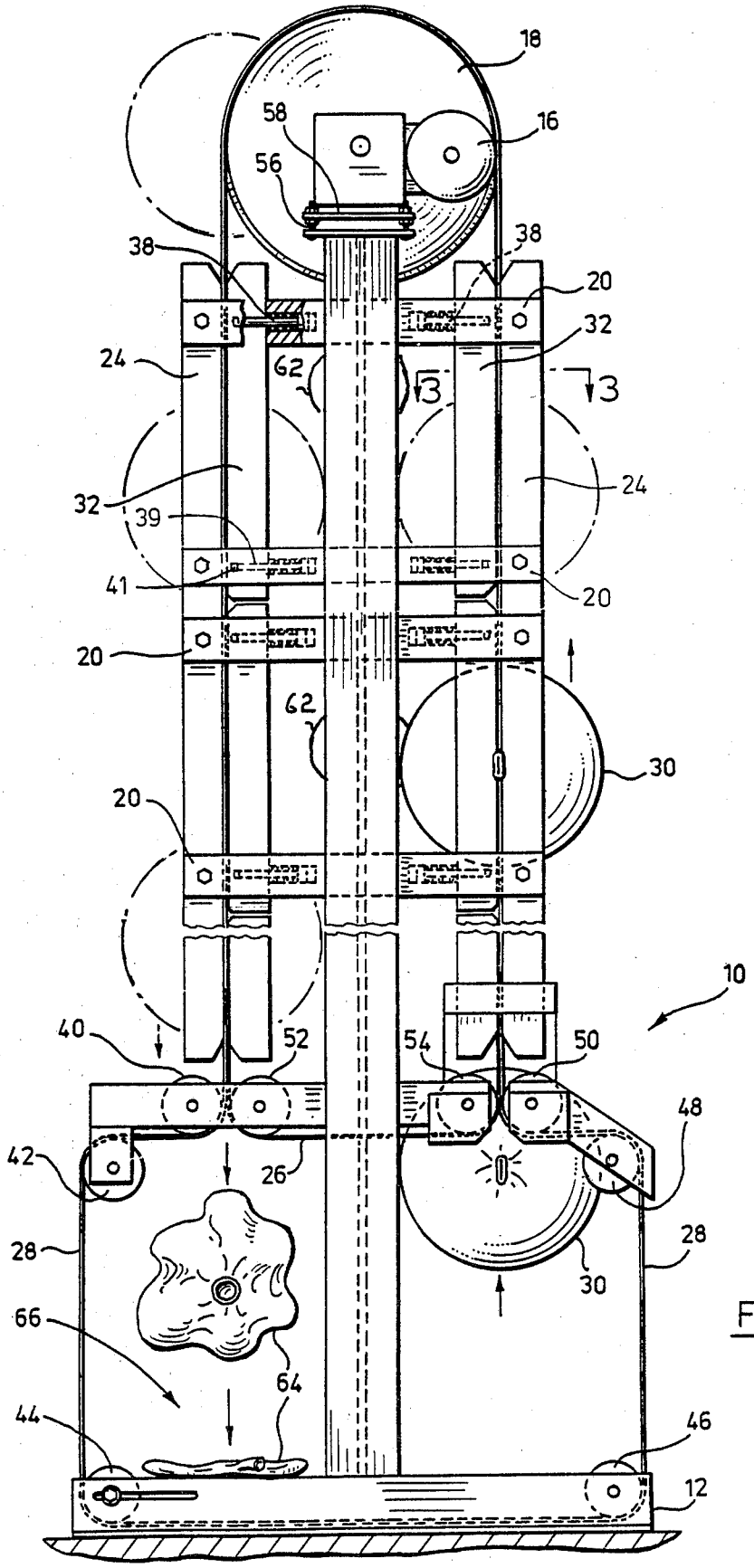

This is a continuation-in-part of application Ser. No. 177,569 filed Aug. 13, 1980 now abandoned.

This invention relates to a device for drying balloons which have been printed with ink or another marking medium.

The balloons with which the invention is concerned are inflatable balloons which have been printed, while inflated, with a design, words or other indicia, and where the printing medium, usually ink, can be dried with heat and/or air.

It is an object of all facets in the invention to provide a balloon dryer wherein the balloon neck is pressed between flights of a pair of belts to maintain the balloon neck sealed to maintain the balloon inflated during the drying process.

It is an object of the invention to provide a balloon dryer in accord with the previous paragraph wherein means are provided for releasably biassing such belt flights together whereby said belt flights may be outwardly spaced against said bias by the thickness of balloon necks pressed between said flights.

It is an object of the invention to provide a balloon dryer in accord with the next previous paragraph whereby said releasable biassing means is designed and constructed to allow differential outward spacing of said belt flights under the outward pressure of such balloon necks.

It is an object of the invention to provide a process for drying balloons comprising transporting such balloons while inflated and maintaining the necks sealed under the clamping pressure between the flights of two belts, while conveying the balloon by movement of the mutually pressing belts at substantially the same speed in the same direction.

It is an object of a preferred aspect of the invention to provide a process for drying balloons comprising transporting such balloons while inflated and maintaining the clamping pressure between the flights of two mutually pressing belts which are designed and driven at the same speed in the same direction by providing that the belts are timing belts, toothed (on the side which does not press on the balloons) and driven by a complementary sprocket drive.

It is an object of a preferred aspect of the invention to provide a balloon dryer wherein the defined path for the two belt flights includes an extent curved in a predetermined sense, whereby one of said belt flights is the inner and the other the outer belt flight.

It is an object of a preferred aspect of the invention to provide means for moving the balloon, so held, along each path, by providing drive means for said inner belt flight, while mounting the outer belt flight to run as an idler and driving the outer belt flight by means of said inner belt flight.

It is an object of a preferred aspect of the invention to provide means for moving a balloon, sealed at its neck between flights of an inner and an outer belt, moving in a curved path; where the belts on their mutually contacting surfaces are provided with surfaces of relatively high frictional quality to facilitate the driving of the outer belt by the inner and where the belts are relatively smooth on their non-contacting surfaces to provide for easy sliding on the guides for the belts.

It is an object of a preferred aspect of the invention to provide means for moving a balloon, sealed at its neck between flights of an inner and an outer belt, moving in a curved path where the inner belt is not more than 3/16" thick, whereby there is a very small difference in length between the inner and the outer belt about said curved extent.

It is an object of a preferred aspect of the invention to provide means for moving a balloon under the criteria of any of the proceeding paragraphs wherein the belts define a path which is of a U-shape defining generally an initial and a final extent of travel which are straight and which are joined by a curved intermediate extent. The use of the U shaped path for a balloon path during drying provides for compactness of the drying path which is both economical of floor space and also presents the balloons, travelling on the path, in a compact array to receive the radiation from drying lamps.

In a preferred form for maximum compactness and saving of floor space the U is arranged standing vertically, and in inverted form.

The advantages and many of the features of the invention will be discussed in the detailed description to follow.

Figure 2:
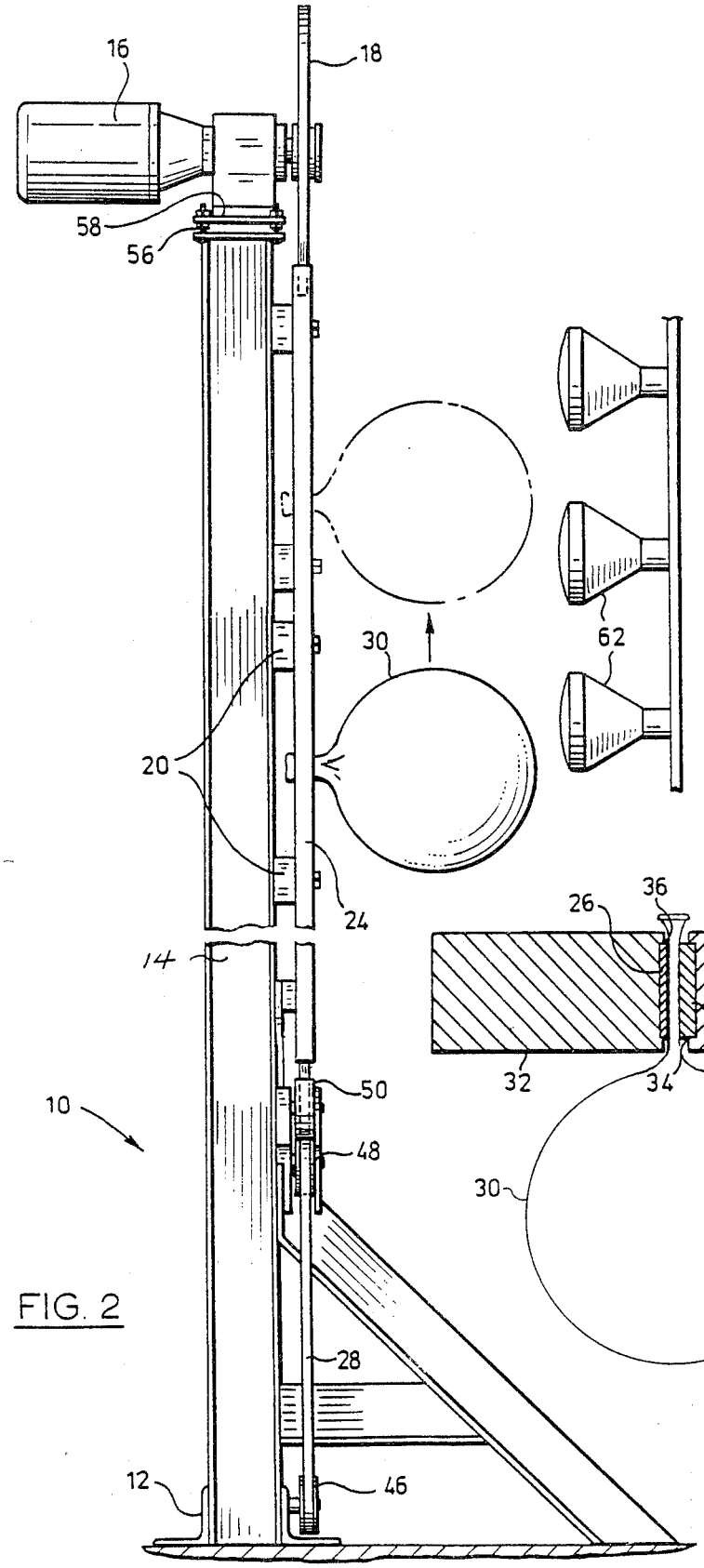
Figure 3:
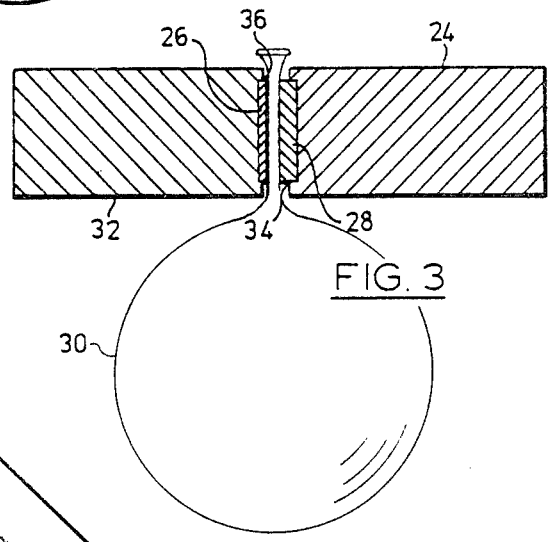
Figure 4:
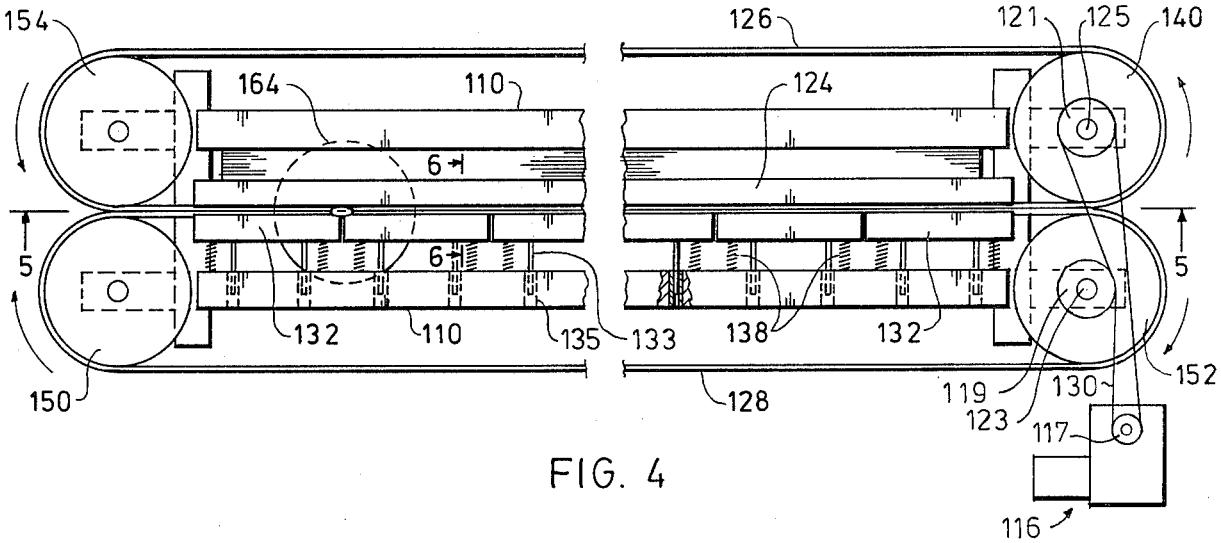
Figure 5:
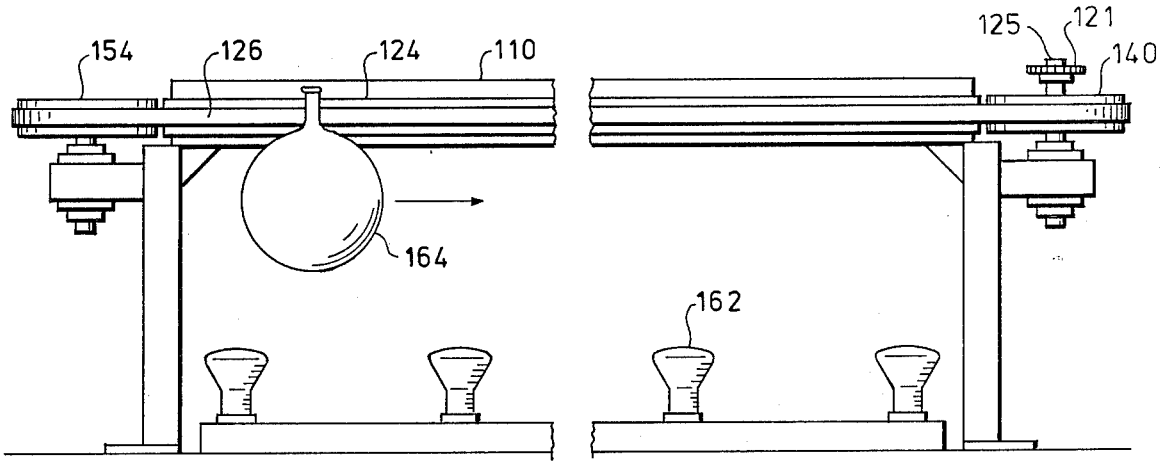
Figure 4A:
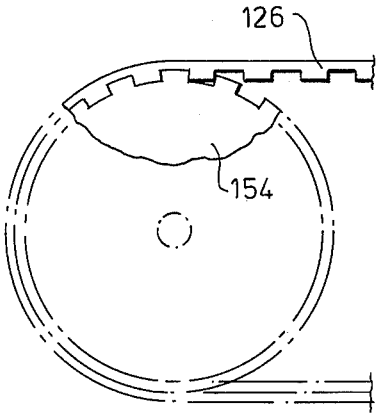
Figure 6:
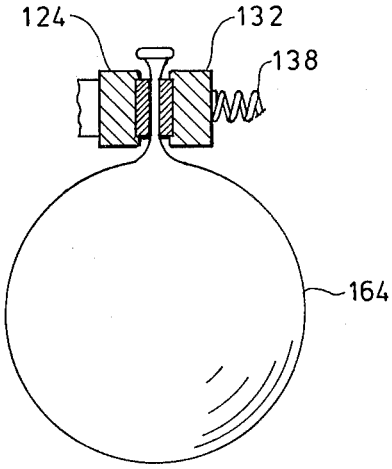

In drawings which illustrate a preferred embodiment of the invention:

FIG. 1 is a vertical elevation of a balloon dryer in accord with the invention, FIG. 2 is a vertical elevation of the device of FIG. 1 and at right angles thereto, and FIG. 3 is an enlarged cross-section of the belts and guides of FIG. 1, FIG. 4 is a plan view of an alternative embodiment of the invention, FIG. 4*a* is an enlargement of a portion of FIG. 4, FIG. 5 is a vertical view along the lines 5—5 of FIG. 4, and FIG. 6 is a partial sectional view along the lines 6—6 of FIG. 4.

In the FIGS. 1–3 drawings the stand 10 comprises a base 12 and a substantially vertical standard 14. At the top of the upright is mounted a motor 16 which drives a belt guide wheel 18 about which the flights of the inner and outer belts travel with the inner belt contacting the guide wheel and the outer belt lying thereon. At spaced intervals along the standard 14 cross bars 20 are provided. Such cross bars 20 mount fixed guide bars 24 inwardly facing on each side of the upright. Such guide bars are grooved at 34 to receive a part (preferably ½) of the thickness of the outer belt 28 but the depth of the grooves 34 in the side bars is such that the inner side of the outer belt 28 is clear of the bars so that the necks of balloons 30 carried between the inner and outer belts will not contact the outer guide bars. Inner guide bars 32 are slidably mounted on the cross bars 20 on each side of standard 14 to provide guide grooves 36 for the outer belt 28, the grooves 36 facing the outer belt and being shallower than the thickness of the inner belt 26 as in the case of the outer guide bars 24 as shown in FIG. 3.

Inner guide bars 32 on each side of standard 14 are preferably formed of relatively short lengths arranged end to end and collectively extending for substantially the same length as bar 24. Each short length of bar 32 is provided with a pair of compression springs 38 which resiliently bias the bar outwardly toward the facing surface of bar 24. The alignment of each of short bar lengths 32 parallel to the bars 24 is assisted by bolts 39 anchored at their inner ends in cross-bar 20 and being, at their outer ends, slidable in grooves 41 in bars 32. In this embodiment the compression springs are located about bolts 39 and bear inwardly against cross-bar 20 and outwardly against bar 32.

The springs 38 arranged as described provide resilient biassing to bias the inner guide bar lengths outwardly with the force necessary to provide that pressure between the inner and outer belt which will maintain the balloon neck sealed between the inner and the outer belt. In the preferred embodiment, this sealing force is achieved by compression springs 38 located between pressure surfaces on a cross bar 20 and on the inner guide bar 32 and arranged to bias the inner guide bar outwardly against the inner belt 26.

The fact that the outwardly biassed guide bars 32 are formed of a plurality of short lengths allows the balloon necks to move the individual bar lengths 32 out to differing degrees if the bottom necks happen to be of different thicknesses, while still maintaining clamping pressure on each balloon neck. It is within the broader scope of the invention to provide a single guide bar 32 running the length of the path on each side of standard 14 and outwardly biassed by springs 38. However, if the balloon necks are of differing thicknesses the clamping pressure thereon is not as consistent as with the short lengths of bar.

It is a viable alternative to the use of the compression springs 38, the fix the inner guide bars 32 and instead make each of the outer guide bars 24 inwardly and outwardly movable and spring biassed inwardly, and preferably to make each guide bar 24 in a plurality of short, end-to-end length to be biassed by springs in a similar manner to the biassing of bar lengths 32 in the first alternative.

Each bar 32 may be made in a single length, but individually responsive to varying balloon neck thicknesses, by making the pairs of bars 24 and 32, or at least the bar 32 of flexible resilient plastic. With such a resilient plastic bar 32, the springs 38 still act on the flexible bar 32 to seal the balloons. However the presence of an unduly thick balloon at some portions only increases the spacing of the bars 32 and 24 at its location by providing a slight bulge in the bar 32 away from the bar 24. However, such extra spacing, because of the resilient flexibility of one or both of the bars.

The apparatus so far described defines a path for flights of the inner and outer belt pair wherein the balloons may be maintained sealed between flights of the inner and outer belts while travelling in an inverted U path, i.e. up on one side of the U upright 14, about a curved path defined by the periphery of wheel 18 and down the other side of the U upright. The remainder of the belt paths will now be described.

The inner belt 26 on its descending course beside standard 14 is led about roller 52 on the frame to diverge from belt 28 and over to a similar roller 54 on the other side of the upright to again converge with belt 28 and begin its ascending course. The tensioning in the inner belt is provided by adjustment of the mount for motor 16 and wheel 18, schematically indicated by bolts 56 adjusting the height of the motor platform 58. Tension on the inner belt 26 is of course also affected by the drive force of the wheel 18.

The outer belt 28 on its descending course beside standard 14 is led outwardly about pulley 40 mounted on the base to diverge from belt 26 and downwardly about pulley 42 to pulley 44, both mounted on the base. Pulley 44 in distinction to the other pulleys bearing on the outer belt, is slidably mounted in the frame (with displacement control means not shown but schematically indicated by the slot 60) so that its axis may be adjusted to maintain the desired degree of tension on the outer belt. The outer belt is then led from pulley 44 about the pulleys 46 and 48 on the other side of the base then about the pulley 50 to lead the outer belt 28 to converge into its course with one side in juxtaposition to inner belt 26.

It will be noted that the inner and outer belts define converging courses at pulleys 54 and 50 so that the necks of inflated balloons may be inserted between the converging belts 26 and 28. Thus the inflated balloons 64, held sealed by an operator's fingers, the balloons carrying designs wet with recently printed ink or other printing medium, are preferably manually fed by the operator between the converging belts 26 and 28 at pulleys 50 and 54. It will be understood that safety guards, not shown, will be provided to minimize the risk of the operator's fingers being caught between the pulleys and belts. The mutually facing flights of belts 26 and 28, after receiving the balloon neck between them, hold the balloon neck sealed and hold the inflated body of the balloon projecting from the belts on the side and in the attitude as shown on the right in FIG. 2. During the travel of the balloon in this attitude the pressure between the belts 26 and 28 is arranged to maintain it sealed. On the upper path such sealing pressure is achieved by the spring loaded guide bar lengths 32. About the wheel 18 the pressure is achieved principally by the tension on outer belt 28. On the downward path such pressure is again achieved by the spring loaded guide bars 32. The balloons travelling the belt path have the printed indicia thereon thus dried by exposure to the air and heating lamps schematically indicated at 62 during their travel on this course. At the bottom of the downward extent of the path, the belts 26 and 28 diverge at pulleys 40 and 52 to release the balloon necks so that the dried balloons 64 are released, deflate and fall deflated in a pile in a storage area 66 for further processing.

The balloon drying procedure requires a curved path (the mutual path of the inside and outside belt 26 and 28) for saving of plant space and area. The preferred form of such curved path is the U shape shown in the drawings. The optimum arrangement for saving of plant space is with such U-shape inverted and projecting upwardly from the plant floor for maximum economy of space and for ease of manual insertion of balloons between the belts.

Whatever the form of curvature, all the preferred designs of the apparatus require such curvature to be in only one sense so that there is defined an inside and an outside belt.

It will be noted that, in the preferred embodiment, the inner belt 26 is driven, while the outer belt 28 is idler mounted i.e. all the wheels and pulleys guiding the outer belt are idlers, none is directly driven. This is to avoid undue tension on the outer belt 28 which would otherwise tend to tear the necks of the balloons 64. Accordingly the only tension provided to the outer belt is a relatively light one created by the tension means at pulley 44.

The idler mounted outer belt 28 is thus frictionally driven by the friction and pressure of the inner belt 26. Such idler drive of the outer belt requires good frictional characteristics on the mutually contacting surfaces of the inner and outer belts. For this I prefer to use Habasit belt models 18E (outer belt) and SAB-5E (inner belt), both manufactured by Habasit Canada Limited of 2278 Spears Rd., Oakville, Ontario, Canada. Such belts have a high friction almost sticky inner surface of PVC plastic and a smooth outer surface of polyethylene.

In order to have good sliding, i.e. low friction, of the belts 26 and 28 over the pressure guides 32 and 24, respectively, a smooth outer surface is provided on the non-contacting surfaces of the belts. Such smooth outer surfaces are also provided by the Habasit belts referred to above. However it is important to note that the high friction contacting surfaces of the belts (required by the idler drive of the outer belt) and the smooth outer surface requires, to the extent that the particular guides shown are used, are not really interdependent. The desired result, achieved as closely as possible, is to have, through this frictional drive of the outer by the inner belt, the two belts travelling at the same speed on the straight extents to avoid stress on the balloon necks. Such stress will be minimized on the curved extent (where the path of the outer belt is longer than that of the inner) to the extent that the difference in velocity of the inner and the outer belts on the curved path is minimized. An important factor in such stress reduction is to provide a narrow thickness for the inner belt which reduces the difference in travel of the two belts about the curved path. For this purpose we prefer to use an inner belt thickness of 0.060". We believe that inner belts of up to 3/16" thickness may be used without probable risk of damage to the balloon necks on the curved path.

A further factor to reduce the damage to the balloons is to have the outer belt resiliently lengthen during its travel about the curved part of the path to compensate for the difference in belt course length, so that the relative belt speeds on the curved path are equal. Thus the outer belt should be made of material sufficiently resiliently stretchable to make the required extension about the curved path. Due to the small difference in path length with the thin inner belt of the dimensions described, such resilient stretchability may be made very small. It will also be desireable, to produce such stretching in the curved path, to have the pressure of the outer belt on the inner higher on the straight extents than on the curves. This may to some extent be achieved by adjustment of the pressure of the sliding guides 32 and adjustment of the tension (at pulley 44) of the outer member.

Due to the requirement for making the inner belt thin, it is preferred to add support therefor from the outer belt. Accordingly, it is preferred to make the outer belt thicker than the inner belt to provide such support. With an inner belt of 0.060" the outer belt may have thickness of 0.060" to 0.250", subject of course to the other criteria for the outer belt, including stretchability on the curve discussed herein.

FIGS. 4–6 show a balloon dryer in accord with the invention utilizing a straight instead of a curved path extent. Timing belt sprockets 154 and 140 mounted on a frame 110 direct and support left hand timing belt 126 and pulleys 150 and 152 direct and support the right hand timing belt 128. The pulleys are located so that one flight of belt 126 is adjacent, facing and substantially parallel to one flight of belt 128. Although one of belts 126 and 128 may be driven and the other may be an idler it is alternatively practical to drive both belts 126 and 128 as shown.

With both belts 126 and 128 driven it is important that they travel at the same speed along the balloon clamping path. To ensure such similar speed a positive synchronism is provided between the drive 116 and the belts. Drive 116 provides a sprocket 117 which drives chain 130. Chain 130 is connected, as shown, to drive sprocket 119 on shaft 123 for timing belt sprocket 152; and to drive sprocket 121 on shaft 125 for timing belt sprocket 140. The paired belt sprockets are of the same diameter and the paths of belts 126 and 128 of the same length. Sprockets 119 and 121 are the same size and, as will readily be appreciated, the path of chain 130 is chosen in relation thereto so that sprockets 119 and 121 on the one hand, and timing belt sprockets 140 and 152 on the other hand rotate in opposite directions to drive the facing surfaces of belts 126 and 128 in the same direction at substantially the same speed. The substantially equal speeds of the belts 126 and 128 can be best assured through the chain drive and the sprocket belt drives described above.

FIG. 4A shows the teeth of timing belt 126 and sprocket 154. Timing belt 128 and sprockets 150, 140 and 152 are of similar construction.

Tensioning means not shown may be provided to control the tension of each of the belt drives. Clamping pressure between the facing belt flights is achieved by the provision of a fixed bar 124 on one side of the belt and a series of bars 132 on the other. As shown in FIG. 6, facing extents of bar 124 and a bar 132 are grooved to depth less than the belt thickness to form guide grooves for the belts. However, in distinction to the embodiment of FIGS. 1–3, both belts and both grooves may be of the same thickness. To maintain sealing pressure (for the balloon necks) between the facing belts the bars 132 are mounted on frame 110 to be slidable toward and away from bar 124 and are spring biassed toward the latter by compression springs 138 to maintain the sealing pressure. As with the embodiment of FIGS. 1–3 the compression springs may be replaced by tension springs again arranged to create the sealing pressure between the belts. The provision of a plurality of spring biassed bars 132 arranged end-to-end along the mutual path of the belts means that the respective thickness of balloon necks may space the belts 126 and 128 differing amounts against the respective springs 138 bias to achieve, for each balloon neck, the sealing pressure to maintain the balloon sealed while it is being inflated.

Alignment of the bars 132 is, in the embodiment of FIGS. 4 to 6 ensured by pairs bolts or shanks 133 projecting outwardly from bar 132 and slidable in sleeves 135. Alternatively the aligning means could be combined with the springs as in the embodiment of FIGS. 1–3.

As indicated in FIGS. 4–6 the attitude of the belt paths is preferably such that the belt path is horizontal and the drying balloons, with their necks sealed between the belts, hang vertically therefrom. Heating lamps 162 are suitably placed to radiate upon the balloons assist in the drying of the balloons.

The belts 126 and 128 define converging courses at the pulleys 154 and 150. Thus the inflated balloons 64, held sealed by an operator's fingers, i.e. the balloons carrying designs wet with recently printed ink or other printed medium, are preferably manually fed by the operator between the converging belts 126 and 128 at pulleys 150 and 154. It will be understood that safety guards, not shown, will be provided, to minimize the risk of the operator's fingers being caught between the pulleys and belt. The belts 126 and 128, after receiving the balloon neck between them, hold the balloon neck sealed and hold the inflated body of the balloon hanging below the belts. During its travel along the path the balloon is clamped sealed between the facing belt flights by the springs 138 as heretofore discussed. The balloons travelling the defined belt path have the printed indicia thereon thus dried by exposure to the air and the schematically indicated heating lamps. At the end of the path the mutually facing flights diverge at pulleys 140 and 152 to release the balloon necks so that the dried balloons are released, deflate and fall deflated in a pile for further processing.

I claim:

1. Balloon dryer comprising:

means defining a path for flights of a pair of belts arranged face-to-face, radiation means for drying inked inflated balloons moving along said path between said belt flights, said path defining a curve in one direction whereby said pair of belts embody an inside belt and an outside belt relative to said curve, means for causing pressure of said inside belt and said outside belt on one another along said path for maintaining substantially sealed therebetween the neck of an inflated balloon, means for driving said inner belt, means mounting said outer belt for moving as an idler driven by said inner belt.

2. Balloon dryer as claimed in claim 1 wherein said belt flights follow converging courses at the entrance to said path, whereby the neck of said balloon may be inserted between said belts and said belt flights follow diverging courses at the exit from said path whereby said balloon may be released from between said belt flights.

3. Balloon dryer as claimed in claim 1 wherein said belt flights on their mutually contacting surfaces are provided with relatively high frictional surfaces whereby said inside belt may drive said outside belt and the respective opposite sides from their mutually contacting surfaces are relatively smooth to allow easy sliding thereof on means pressing said belts into mutual contact.

4. Balloon dryer as claimed in claim 2 wherein said belt flights on their mutually contacting surfaces are provided with relatively high frictional surfaces whereby said inside belt may drive said outside belt and the respective opposite sides from their mutually contacting surfaces are relatively smooth to allow easy sliding thereof on means pressing said belts into mutual contact.

5. Balloon dryer as claimed in claim 1 wherein said inner belt is not more than 3/16" thick.

6. Balloon dryer as claimed in claim 2 wherein said inner belt is not more than 3/16" thick.

7. Balloon dryer as claimed in claim 3 wherein said inner belt is not more than 3/16" thick.

8. Balloon dryer as claimed in claim 4 wherein said inner belt is not more than 3/16" thick.

9. Balloon dryer as claimed in claim 1 wherein said outer belt is thicker than said inner belt.

10. Balloon dryer as claimed in claim 2 wherein said outer belt is thicker than said inner belt.

11. Balloon dryer as claimed in claim 3 wherein said outer belt is thicker than said inner belt.

12. Balloon dryer as claimed in claim 4 wherein said outer belt is thicker than said inner belt.

13. Balloon dryer as claimed in claim 5 wherein said outer belt is thicker than said inner belt.

14. Balloon dryer as claimed in claim 6 wherein said outer belt is thicker than said inner belt.

15. Balloon dryer as claimed in claim 7 wherein said outer belt is thicker than said inner belt.

16. Balloon dryer as claim in claim 8 wherein said outer belt is thicker than said inner belt.

17. Balloon dryer comprising:

means defining a path for flights of a pair of belts arranged face to face, radiation means for drying inked balloons moving along said path held between said belt flights, said path defining a curve in one direction whereby said pair of belts respectively embody an inside belt and an outside belt relative to said curve, said outside belt being constructed of material sufficiently stretchable to allow for an increased length of said outside belt at said curve, means for causing pressure of said inside belt and said outside belt on one another along said path for maintaining substantially sealed therebetween the neck of an inflated balloon, means for driving said inner belt, means mounting said outer belt for moving as an idler driven by said inner belt.

18. Balloon dryer as claimed in claim 17, wherein said belt flights follow converging courses at the entrance to said path, whereby the neck of said balloon may be inserted between said belt flights and said belts follow diverging courses whereby said balloon may be released from between said belts.

19. Balloon dryer as claimed in claim 17 wherein the thickness of said inner belt is not more than 0.125".

20. Balloon dryer as claimed in claim 18 wherein the thickness of said inner belt is not more than 0.125".

21. Balloon dryer as claimed in claim 19 wherein said outer belt is thicker than said inner belt.

22. Balloon dryer as claimed in claim 20 wherein said outer belt is thicker than said inner belt.

23. Balloon dryer as claimed in claim 17 wherein said guides are used to press one of said belts against the other and said belts are relatively smooth on their non-contacting side and have a relatively high coefficient of friction on their mutually contacting surfaces.

24. Balloon dryer as claimed in claim 18 wherein side guides are used to press one of said belts against the other and said belts are relatively smooth on their non-contacting side and have a relatively high coefficient of friction on their mutually contacting surfaces.

25. Balloon dryer as claimed in claim 1 wherein said path is in the shape of a U with said cure corresponding to the cross bar of the U.

26. Balloon dryer as claimed in claim 2 wherein said path is in the shape of a U with said curve corresponding to the cross bar of the U.

27. Balloon dryer as claimed in claim 17 wherein said path is in the shape of a U with said curve corresponding to the cross bar of the U.

28. Balloon dryer as claimed in claim 18 wherein said path is in the shape of a U with said curve corresponding to the cross bar of the U.

29. Balloon dryer as claimed in claim 25 wherein said path is arranged so that said U is inverted and said portions of said path representing the uprights of said U extend approximately vertically.

30. Balloon dryer as claimed in claim 26 wherein said path is arranged so that said U is inverted and said portions of said path representing the uprights of said U extend approximately vertically.

31. Balloon dryer as claimed in claim 27 wherein said path is arranged so that said U is inverted and said portions of said path representing the uprights of said U extend approximately vertically.

32. Balloon dryer as claimed in claim 28 wherein said path is arranged so that said U is inverted and said portions of said path representing the uprights of said U extend approximately vertically.

33. Balloon dryer comprising:

means defining a path for a pair of belts having respective flights arranged face-to-face, radiation means for drying inked inflated balloons moving along said path between said belts, means for causing mutual pressure between the face-to-face flights of said belts on one another, substantially continuously along said path, for maintaining the neck of an inflated balloon substantially sealed therebetween, means for causing said face-to-face flights to move in the same direction along said path at substantially the same speed.

34. Balloon dryer as claimed in claim 33 wherein said belts follow converging courses at the entrance to said path, whereby the neck of said balloon may be inserted between said belts and said belts follow diverging courses at the exit from said path whereby said balloon may be released from between said belts.

35. Balloon dryer as claimed in claim 33 wherein said means for causing mutual pressure between said belts comprises members releasably biassing said belts together.

36. Balloon dryer as claimed in claim 34 wherein said means for causing mutual pressure between said belts comprises members releasably biassing said belts together.

37. Balloon dryer as claimed in claim 1 wherein said means for causing pressure comprises members releasably biassing said belts together.

38. Balloon dryer as claimed in claim 35 wherein said releasable biassing means is designed to allow differential spacing of said belts along said path due to the thickness of balloon necks therebetween.

39. Process for drying printing medium on inflated balloons, comprising the steps of:

inserting the neck of each of said inflated balloon between a pair of mutually facing belt flights, causing said mutually facing belts to press together to maintain said balloon neck sealed, causing said mutually facing belts flights to travel in the same direction at substantially the same speed along a predetermined path;

causing said balloons to pass a radiation means for drying said printing medium on said inflated balloons.

40. Balloon dryer as claimed in claim 33 wherein said belts are each timing belts tooth on the side remote from side thereof which presses on the balloons, such belts being driven by complementary toothed timing belt sprockets, and wherein means are provided for driving said sprockets to cause the facing surfaces of said belts along said path to travel at substantially the same speed in the same direction.

41. Balloon dryer as claimed in claim 35 wherein said belts are each timing belts toothed on the side remote from side thereof which presses on the balloons, such belts being driven by complementary toothed timing belt sprockets, and wherein means are provided for driving said sprockets to cause the facing surfaces of said belts along said path to travel at substantially the same speed in the same direction.

* * * * *